United States Patent [19]

Roberts

[11] Patent Number: 4,519,173

[45] Date of Patent: May 28, 1985

[54] SLAB-HANGING SYSTEM

[75] Inventor: Lewis L. Roberts, Indianapolis, Ind.

[73] Assignee: Mercury Development Corp., Indianapolis, Ind.

[21] Appl. No.: 385,861

[22] Filed: Jun. 7, 1982

[51] Int. Cl.[3] ..... E04H 1/04

[52] U.S. Cl. ..... 52/235; 52/509

[58] Field of Search ..... 52/136, 255, 710, 509, 52/235, 234

[56] References Cited

U.S. PATENT DOCUMENTS 3,897,663 8/1975 Gaul ..... 52/136

4,064,664 12/1977 Gaul ..... 52/136

*Primary Examiner*—James L. Ridgill, Jr.

*Attorney, Agent, or Firm*—Robert A. Spray

[57] ABSTRACT

A slab-hanging system for a vertically arranged series of removable slabs, which achieves proper location of all slab-supports by the combination of a series of vertical support column members, each of which is adjustable horizontally, vertically and outwardly of the building's associated supporting structure, and slab-supporting hanger devices mounted on the column members; the full adjustability of the column members achieves the proper alignment and positioning of all the hanger devices.

1 Claim, 10 Drawing Figures

SLAB-HANGING SYSTEM

The present invention relates to a slab-hanging system, such as for the marble facing of mausoleum crypts, in which heavy slabs are supported in a removable manner and in an arrangement which is in effect both a vertical and a horizontal series.

More particularly, the present invention relates to an integrated slab-supporting system for the removable support of such slabs, it being integral in the sense that its various components and features co-operate to achieve the proper alignment and positioning of such slabs, even though the associated supporting structure may be somewhat irregular of surface, and even though there is the likely possibility of some mis-alignment of the system's supporting devices which are inset into the concrete of the building's supporting structure upon which these large and quite heavy slabs are hung or mounted.

In carrying out the invention in a preferred embodiment, there is provided a combination of two basic components or sets thereof. That is, there are provided, horizontally-spaced, a series of vertical support column members, and each of these are provided with full adjustability (horizontally, vertically, and outwardly) with respect to the associated supporting structure; and there are provided shelf-like supporting hanger devices for mounting on to those support column members.

The overall or integrated arrangement thus provides and assures a full and proper orientation (alignment and positioning) of the whole array of the crypt slabs, by the principle that the support column members are themselves first properly positioned and oriented in all respects, and all the shelf-like hanger devices are thus automatically properly positioned and aligned by their mounting onto the support column member. This assurance of proper orientation and alignment and positioning of all the hangers and all the support column members is assured by the relatively easily-maintained close tolerances of metal-forming procedures; and this is quite in contrast to the difficulties and seeming impossibilities of close tolerances of attachments embedded in the concrete of associated supporting structure, and in contrast to the irregularities usually present in the outer face of concrete supporting structure, and in contrast to a support column which although initially positionable as to proper orientation and alignment does not provide easily-assured proper mounting of individual slabs.

The prior art is quite close to individual components of the combination here achieved, as is now shown, but that very similarity with respect to individual components of the inventive combination helps show the non-obviousness of the concepts as an operative combination; and the prior art also indicates the non-obviousness of the present combination, as shown below, by the fact that the present invention is a departure from the slab-mounting concepts of the latter of the prior art.

The prior art for years is represented by the following U.S. Patents:

J. B. Sinner, J. W. Rickards, et al, U.S. Pat. No. 3,342,005, Sept. 19, 1967,

J. B. Sinner, et al, U.S. Pat. No. 2,853,870, Sept. 30, 1958,

J. B. Sinner, et al, U.S. Pat. No. 2,618,145, Nov. 18, 1952,

J. B. Sinner, et al, U.S. Pat. No. 2,574,938, Nov. 13, 1951,

J. B. Sinner, et al, U.S. Pat. No. 2,363,156, Nov. 21, 1944, and J. B. Sinner, U.S. Pat. No. 2,080,190, May 11, 1937.

Additional prior art has been found to be devices of Aeon Mfg. Co., 929 W. 253rd Street/P.O. Box 351, Harbor City, Cal. 90710. These appear quite similar to the above-cited Sinner Brothers, Inc., devices in being mounted directly into the concrete, and in other features. They apparently were not patented; and although specimens show numerals (2,768,001 and 2,768,002), those are not U.S. patent numbers for devices of this field. But whether patented or not, they fail to suggest a unitary and 3-way adjustible mounting column as in the combination of the present invention.

Accordingly, in realistically evaluating these prior art references, to realistically consider the present invention against the actual background of prior art, it is expressly noted that the above-listed prior art references show various concepts relating to shelf-like slab hangers or mounts such as are incorporated in the present invention of a combination. However, they all fail to show or suggest a vital component and concept of the combination, i.e., they fail to show or suggest vertical support column devices for the mounting of the slab-hangers or mounts; and thus these references fail operationally to achieve a proper positioning of the slab-hangers or mounts, for those references depend upon the hope (often an illusory hope) that sufficient proper alignment and positioning of the slab-hangers or mounts can be somehow achieved by their being partially embedded into the concrete of the associated supporting structure.

For years, devices according to one or more of those references were marketed, but all sorts of installation tricks or gimmicks seemed to be required; for the embedding of the slab-hangers or mounts in concrete, and the individual type of support of the hangers or mounts, did not achieve their proper positioning, particularly considering the desired appearance of extremely accurate and attractive flushness of the crypt slabs of a large array of such slabs.

After many years of struggling with problems of mis-alignment, etc., as indicated above, there was developed a vertical support member type of installation, as shown in U.S. Pat. No. 3,897,663, and U.S. Pat. No. 4,064,664, an embodiment of the latter patent being the commercial device as advertised by Crypt Systems, Inc., 165 East Erie St., Chicago, Ill. 60611. These were indeed a departure from the individually-retained hangers or mounts of the above list, and seem to be an improvement indeed, for they provided a series of vertical support channels which could be themselves adjusted, as sub-mounts for individual slab-hangers.

However, this prior art by Crypt Systems, Inc., still produced alignment problems, for in the embodiments of U.S. Pat. No. 3,897,663, the adjustment was only vertical (notches 35), with slab-hangers of the shelf-type as in the Sinner Bros. devices, thus failing to provide the greatly needed operatively universal adjustability provided in the combination of the present invention. That patent's other embodiment, also with only vertical adjustability, used diagonally mounted cleats (48) with diagonal slab-recesses (47), still productive of alignment problems. The devices of Crypt Systems, Inc., as advertised and sold, and as shown in the embodiment of FIGS. 5-7 of U.S. Pat. No. 4,064,664, do indeed provide such universal adjustability, but they do not provide the shelf-type slab-hangers which are featured in the combination of the present invention. That is, as they are shown in FIGS. 5–7 of that patent, and advertised and sold, the Crypt Systems devices having no slab-hangers of a shelf-type upon which the slabs would seat, and, instead have curved brackets which are pre-affixed to recesses cut into the slabs; and thus alignment and positioning problems still existed, particularly recognizing the reality that when Crypt Systems, Inc., finally provided a pre-mount vertical channel having more than merely the insufficient vertical adjustability, they had departed from the shelf-type slab mount components. The embodiment shown in FIGS. 1–4 of U.S. Pat. No. 4,064,664 also appears to have the 3-way adjustability, i.e., vertical, horizontal, and outwardly; but neither that or the other embodiment of that patent have a shelf-like slab hanger, which provides a support shelf.

With each of the prior art references, of the patents or of the commercial and advertised products, and even though they may have appeared theoretically to be usable, the designs in every case were such as to require unattainable tolerances and installation procedures.

Such was the state of the art when the present invention was achieved, of a combination which showed a successful integration of concepts from both types of prior devices, yet a departure from each type, as herein explained.

The above description is of somewhat introductory and generalized form. More particular details, concepts, and features are set forth in the following and more detailed description of an illustrative embodiment, taken in conjunction with the accompanying drawings, which are of somewhat schematic and diagrammatic nature, and in which:

FIG. 1 is a pictorial view of a large portion of an overall installation of a slab-hanging means or system for mausoleum crypts, showing portions of several of the crypt-faces or slabs being removably supported on the supporting structures of the building, i.e., the concrete floor and shelves of the building, by the combination of vertical column members of 3-way adjustable nature, and having shelf-providing slab-hangers mounted thereon, all according to the concepts of the present invention;

FIG. 2 is a pictorial view of a connector member which provides support for and horizontal shifting of the vertical column members of FIG. 1, for horizontal adjustment thereof;

FIG. 3 is a fragmental vertical cross-sectional view of a portion of the installation shown in FIG. 1, being taken generally as indicated by each of the sets of Section-lines 3—3 of FIG. 1, showing the installation of the vertical column members on the building's concrete risers or fore-and-aft walls by use of the connector members of FIG. 2, and also showing aspects of vertical adjustability of the column member with respect to the concrete framing of the associated building structure;

FIGS. 4 and 5 are detail views of a shim piece for use in the installation-portion shown in FIG. 3, to achieve fore-and-aft or outward adjustability of the column member of FIG. 1, FIG. 5 being shown as a section taken generally as indicated by Section-line 5—5 of FIG. 4;

FIG. 6 is a fragmental vertical cross-sectional view of a portion of the overall installation illustrated in FIG. 1, showing the installation of shelf-type slab-hanger devices of FIGS. 1, 7 and 8 on a vertical support column member of FIG. 1, and particularly also showing a portion of slabs being supported on the shelf-components of one of those devices, the view being generally as taken by each set of Section-lines 6—6 of FIG. 1;

Figures 1, 2:
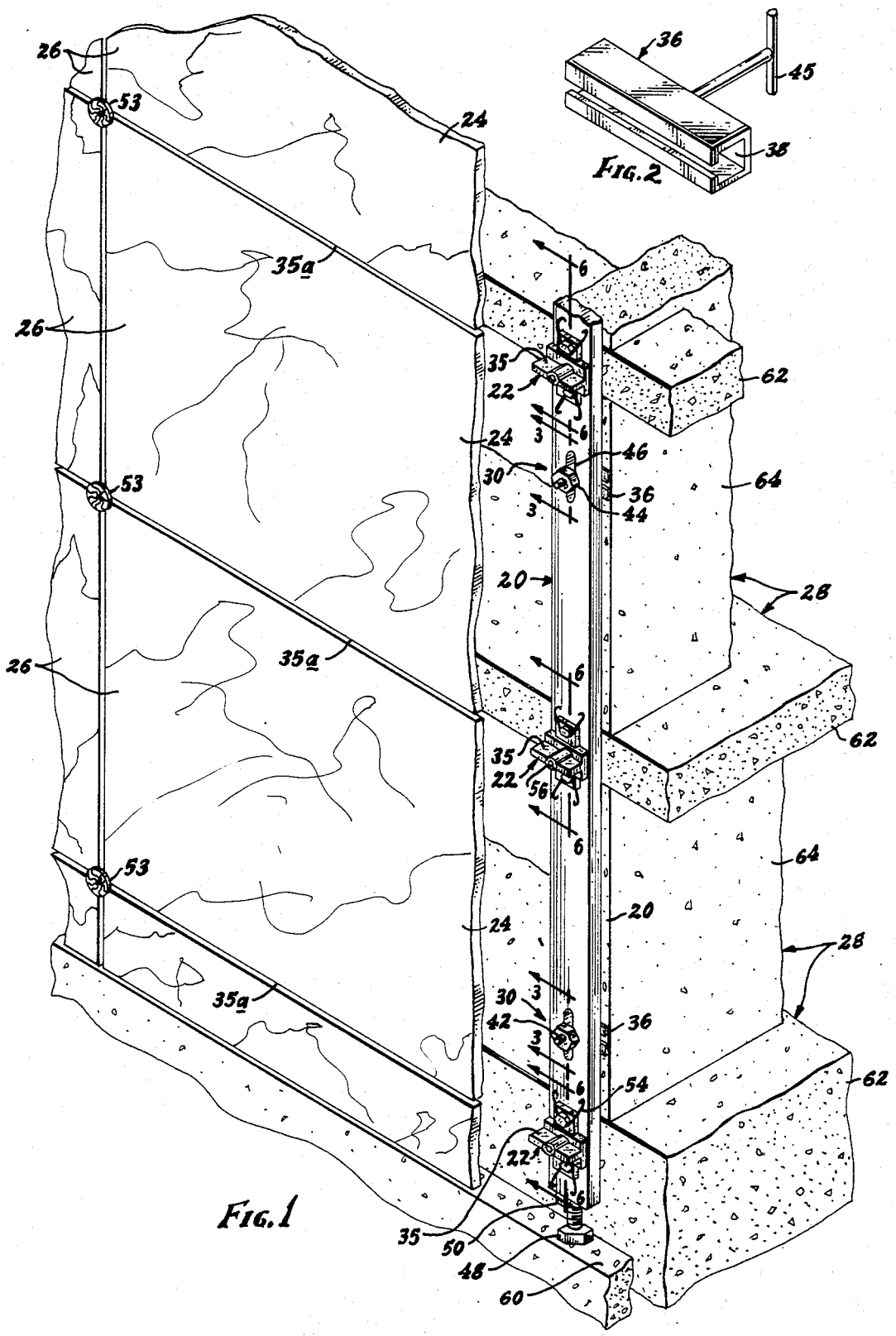

As shown in the drawings, the inventive concepts provide the combination of a pre-adjustable support column 20, fully adjustable as herein specified, with shelf-like slab-mounts or hangers 22, in a combination which provides ease of installation of heavy slabs 24 in an attractive array in which all the slabs' outer surfaces 26 are flush or co-planar.

The slab-hanging means of this combination provides that the slabs 24 are removably supported, such as in a mausoleum, with a vertically-arranged series of such slabs 24 upon associated supporting structure 28, conventionally concrete of the building framing.

For the vertical support column members 20, sometimes referred to as grid bars due to their integrated appearance as a grid when assembled in an overall installation, they are provided with retaining means 30 for retaining the support column members 20 to the associated supporting structure 28; and the retaining means 30 is shown as providing full adjustments, i.e., adjustments both horizontally and vertically and outwardly, with respect to the associated supporting structure 28, for achieving a uniform and accurate positioning of each of the support columns 20 as units, thus assuring that all the slab-hangers 22 for the slabs 24 will be properly positioned so that all the slabs 24 will be automatically positioned in the desired attractive flush or co-planar position when the slabs 24 are mounted on the mounts 22.

Figure 6:
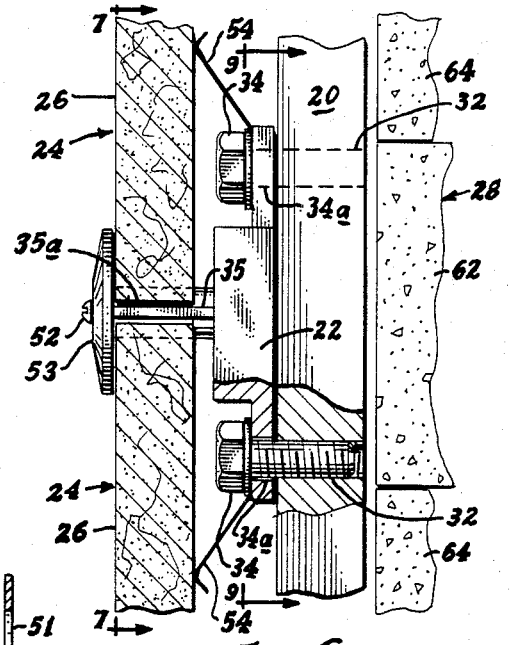

The support column member 20 is shown as provided (FIG. 6) with a series of spaced connector means shown as threaded openings 32, and there is provided a shelf-like slab-mount or hanger 22 for each of the series of these spaced openings 32, the openings 32 being shown as provided on sets of two.

Bolts 34 provide interconnecting means which interconnect each of the slab-hangers 22 to the support column member 20 by threaded engagement with respective ones of said connector holes 32; and the accurate spacing of the holes 32 provides a proper uniformity of spacing of the slab-mounts 22. The bolts 34 pass through holes 34*a* in hangers 22, spaced as per holes 32 of bars 20.

The accurately-located slab-hangers or mounts 22, therefore, each provide a shelf-like support abutment or shelf 35 upon which may releasably rest one of the heavy slabs 24; and the full adjustability of all the support column members 20 achieves automatically the proper alignment and positioning of all of the said slab-hangers 22 mounted thereon, fully assuring that all bottom edges 35*a* of slabs 24 supported in the series will be properly aligned and positioned when seated upon the respective slab hanger 22. This combination of concepts takes advantage of the ease and certainty of proper positioning of the vertical support grids 20 and the conveniently usable shelf-like slab-mounts or hangers 22.

Figure 3:
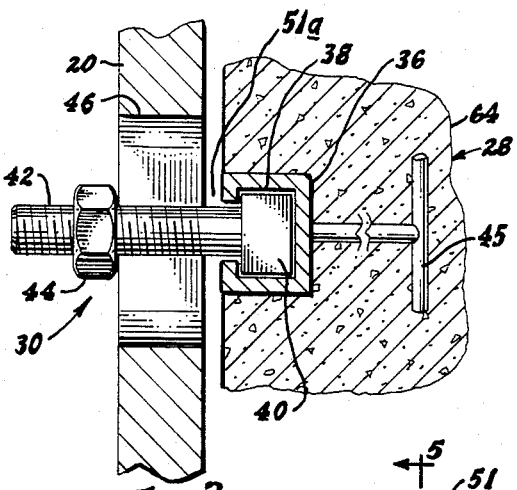

In more particular reference to the mounting of the vertical grid bars 20 onto the concrete supporting frame 28 of the building, the retaining means 30 is shown as comprising (FIGS. 1, 2 and 3) a receiver member 36 provided as an embedded attachment to the associated supporting structure 28 of the building. This form provides an open interior 38 of the receiver member 36 which horizontally slidably but non-rotatably receiving a nut means 40 which is threadedly engageable with a bolt means 42 which extends through and whose head-nut 44 operatively bears onto the vertical support column member 20, that slidability providing ample horizontal adjustment of the vertical support column member 20 with respect to the concrete building framing 28. The receiver 36 is of a generally C-shape as viewed from the end; and rearwardly it carries a retainer 45 for anchoring in the concrete 64 of framing 28.

Vertical adjustment of the column members 20 is also provided, as now detailed. That is, the vertical support column member 20 is shown provided with a vertical slot means 46 through which the bolt means 42 extends, providing for the vertical adjustment of the vertical support column member 20 with respect to the concrete 28. Also, each of the vertical support members 20 is shown provided with a vertical height adjustment bolt means 48 which is itself supported upon the associated flooring; and that adjustment bolt 48 provides at least substantially all of the vertical support of the support column member 20. The above-mentioned vertical adjustment slot feature 46 of the retaining means 30 which retains the support column members 20 to the associated supporting structure 28 accommodates the height-adjustment effect of the vertical height-adjustment bolt 48 but contributes at most only a small portion of all of the vertical support of the column member 20.

The vertical height-adjustment bolt 48 is of conventional form, i.e., it is screw-threadedly received in an opening in the bottom of the vertical support member 20, and a locking nut 50 is shown as provided to maintain a specific height-adjustment.

Figure 4:
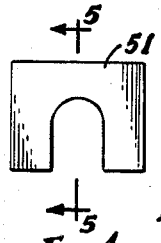
Figure 5:
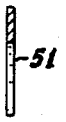
Figure 7:
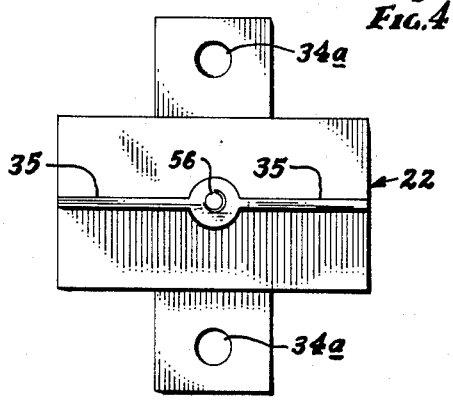
FIG. 7 is a front elevational view of one of the slab-hanger devices of FIGS. 1, 6, and 8, shown as indicated by View-line 7—7 of FIG. 6 although with other components of that FIG. 6 removed.
Figure 8:
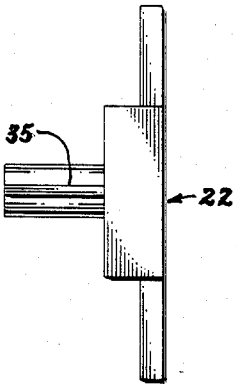
FIG. 8 is a side elevational view of the slab-hanger device of FIGS. 1, 6 and 7.
Figure 9:
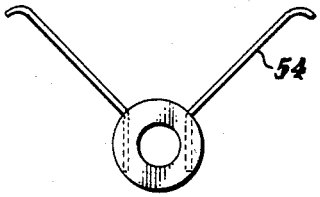
FIG. 9 is a front elevational view of one of the pressure-spring units of FIGS. 1, 7, and 8, shown as indicated by View-line 9—9 of FIG. 7.
Figure 10:
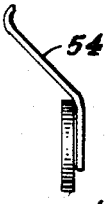
FIG. 10 is a side elevational view of the pressure-spring unit of FIG. 9.

Outward adjustment also is provided in connection with the retaining means 30, and thus as to the relative position of each support grid 20; and such adjustment is shown (FIGS. 4, 5) by the shims 51 insertable between the concrete 28 and the grid bar 20 at the location of the bolt 42 and the embedded receiver member 36. That location is shown by numeral 51*a* in FIG. 3; and after installation is made the front end of bolt-rod 42 is cut off.

Each of the slab-hangers or mounts 22 is provided with a retainer member shown as a bolt 52 having a designed head or washer 53 (sometimes referred to as a rosette) for releasably retaining the associated slab 24 onto the respective slab-hanger 22. Also, as is conventional, each of the slab-hangers 22 (FIGS. 1, 6, 9, 10) also includes spring means 54 which operatively bears upon the associated slab 24 and the support column member 20, the spring 54 being in a state of compression when the associated slab 24 supported by the slab hanger 22 is releasably connected to the mount 22 by the retainer bolt 52. The bolt 52 is held by a threaded opening 56 in the hanger-mount 22; and the spring 54 is held by the bolt 34.

The various components of the building's structure (generally indicated by numeral 28) are shown as follows: the floor 60 is the structure upon which the height-adjustment bolt 48 seats; the horizontal crypt-shelves 62 are at the general elevation of the slab-hangers 22, each adjacent set of such shelves 62 defining the vertical limits of a crypt whose front face is provided by one of the slabs 24; and the vertical risers 64 provide the side walls of each crypt and provide the supporting mount or framing for each of the retainer assemblies 30 which provide for and accommodate the 3-way adjustability (horizontal, vertical, and fore-and-aft or outward adjustability) of each of the grid-columns 20.

It is thus seen that a slab-hanging system according to the inventive concepts of an integral combination as herein set forth provides a desired and advantageous device, yielding the advantages of ease of installaton of an array of slab-facings such as in a whole array of crypts of a mausoleum, with ease of proper alignment and positioning assuring an attractively neat and flush appearance of the whole array, even though supported by concrete building components having irregularity of surface features.

Accordingly, it will thus be seen from the foregoing description of the invention according to this illustrative embodiment, considered with the accompanying drawings, that the present invention provides new and useful combination concepts of a novel and advantageous slab-mounting system, yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

What is claimed is:

1. Slab-hanging means for removably supporting a vertically-arranged series of slabs upon associated supporting structure, the slab-hanging means comprising, in combination:

a vertical support column member;

retaining means for retaining the support column member to the associated support structure, the retaining means providing adjustments both horizontally and vertically and outwardly, with respect to the associated supporting structure;

the support column member being provided with a series of spaced connector means for co-operating with interconnecting means as mentioned below;

a shelf slab-hanger for each of the series of spaced connector means;

interconnecting means for interconnecting each of the slab-hangers to the support column member by co-operation with respective ones of said connector means;

the said slab-hangers each providing a support shelf or abutment upon which may rest one of said slabs, and the full adjustability of the support column member achieving the proper alignment and positioning of all of the said slab-hangers mounted thereon, and thus assuring that all slabs supported in the series will be properly aligned and positioned when seated upon the respective slab hanger.

* * * * *